US010637119B2

(12) United States Patent
Altan et al.

(10) Patent No.: US 10,637,119 B2
(45) Date of Patent: Apr. 28, 2020

(54) REDUCED SIZE PHASE SHIFTER

(71) Applicant: ASELSAN ELEKTRONIK SANAYI VE TICARET ANONIM SIRKETI, Ankara (TR)

(72) Inventors: Hakki Ilhan Altan, Ankara (TR); Remzi Köksal, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 1 day.

(21) Appl. No.: 16/244,134

(22) Filed: Jan. 10, 2019

(65) Prior Publication Data

US 2019/0214696 A1 Jul. 11, 2019

(30) Foreign Application Priority Data

Jan. 10, 2018 (TR) ..... a 2018/00347

(51) Int. Cl.

| | |
|---|---|
| ***H01P 1/195*** | (2006.01) |
| ***H01P 1/18*** | (2006.01) |
| ***H01P 3/06*** | (2006.01) |
| ***H01Q 3/34*** | (2006.01) |
| ***H01P 3/08*** | (2006.01) |
| ***H01P 5/08*** | (2006.01) |

(52) U.S. Cl.

CPC ..... *H01P 1/182* (2013.01); *H01P 1/183* (2013.01); *H01P 1/195* (2013.01); *H01P 3/06* (2013.01); *H01P 3/081* (2013.01); *H01P 5/085* (2013.01); *H01Q 3/34* (2013.01)

(58) Field of Classification Search

CPC .. H01P 1/195; H01P 1/182; H01P 1/18; H01P 1/30; H01P 5/085; H01P 5/087

USPC ..... 333/24.1, 248, 157, 156, 158

See application file for complete search history.

(56) References Cited

U.S. PATENT DOCUMENTS

| | | | | |
|---|---|---|---|---|
| 3,524,152 | A | 8/1970 | Agrios et al. | |
| 4,349,790 | A * | 9/1982 | Landry | H01P 5/103 333/24.1 |
| 5,075,648 | A | 12/1991 | Roberts et al. | |
| 5,812,032 | A | 9/1998 | Stitzer | |
| 2015/0311573 | A1 * | 10/2015 | Alexander | H01P 1/195 333/158 |

* cited by examiner

*Primary Examiner* — Stephen E. Jones

(74) *Attorney, Agent, or Firm* — Bayramoglu Law Offices LLC

(57) ABSTRACT

A reduced size phase shifter provides the orientation of the microwave beams. The phase shifter includes RF connector (4) that provides the entrance of the coaxial transmission line (8) into the phase shifter (1), dielectric plate (7) with high dielectric constant that provides the gradual transformation of the quasi TEM mode carried by means of the micro-strip transmission line (6) into TE10 mode carried on the twin-toroid structure (5).

3 Claims, 2 Drawing Sheets

REDUCED SIZE PHASE SHIFTER

CROSS REFERENCE TO THE RELATED APPLICATIONS

This application is based upon and claims priority to Turkish Patent Application No. 2018/00347, filed on Jan. 10, 2018, the entire contents of which are incorporated herein by reference.

TECHNICAL FIELD

The invention is related to the reduced size phase shifter that provides steering of the microwave beams particularly used in the radar systems.

BACKGROUND

The phase shifters that are durable against high power generally cover a big area with its wave guide structure. In some specific radar applications, the spacing between phase shifter elements forming the antenna array should be smaller than the quarter wavelength to make them fit into the antenna array. Current high-powered phase shifters cannot fulfill this requirement.

In the patent document No U.S. Pat. No. 3,524,152 included in the known state of the art, it is seen that the Twin-Toroid Phase shifter is adapted to the standard wave guide structure by means of dielectric impedance elements by being located in the wave guide. The area that this structure covers is big because the width of the standard wave guide is larger than the half wave length. The wave guide-coaxial adaptors to be used in order to provide passage to the coaxial transmission line will cause the structure length to increase more.

In the patent document No U.S. Pat. No. 5,812,032 included in the known state of the art, a method for transferring to the Strip line transmission line form Twin-Toroid Phase Shifter is described. In order to provide the transfer, two dielectric base materials with high dielectric constant and transfer patterns formed by metalizing both the front and rear surfaces of these structures are used. Then, these structures are adhered to each other and subsequently to the twin-toroid structure. This type of transfer increases insertion loss, and total phase shifter length Therefore, this structure is not appropriate for a compact, low-loss phase shifter.

In the patent document No U.S. Pat. No. 5,075,648 included in the known state of the art, a method for the transfer from Twin-Toroid Phase Shifter to Micro-strip line transmission line is described. A capacitor with a low capacitive value is located on the micro-strip line for enabling transfer and a connection is made with the conductive strip wire to the twin-toroid structure through this capacitor. In order to provide the appropriate band width, the requirement of fine adjustment of the capacitor values and strip wire length brings production difficulties. In addition to this, the transfer from the micro-strip line to the coaxial transmission line is not stated within this patent document.

As a result of the above-mentioned disadvantages and the insufficiency of the current solutions in terms of the subject, it is required to make an improvement in the related technical field.

SUMMARY

The invention is to provide a structure that has different technical structures by bringing a new improvement in this field that is different from the configurations used in the current technical field.

The particular aim of the invention is to provide a substantially reduced size twin toroid phase shifter that has a larger structure and width in the current art. Therefore, the phase shifter can be used in some specific radar applications wherein it must fit into a circular section that has a quarter wave length diameter of the cross-sectional area.

Another aim of the invention is to provide a phase shifter that can be produced easily and has a low insertion loss and cost.

In order to fulfill the above-mentioned aims; the invention is a reduced size phase shifter that provides the steering of the micro wave beams, characterized in comprising the following;

- RF connector that provides the connection for the coaxial transmission line into the phase shifter,
- a micro-strip transmission line that provides an interface between a RF connector and a dielectric plate,
- Dielectric plate with high dielectric constant that provides the gradual transformation of the quasi TEM mode carried by means of the micro-strip transmission line into TE10 mode carried on the twin-toroid structure.

The structural and characteristic features and all advantages of the present invention will be understood clearly by the following drawings and the detailed description written with reference to these drawings and therefore the evaluation shall be made by taking these figures and the detailed description into consideration.

BRIEF DESCRIPTION OF THE DRAWINGS

The drawings shall not be scaled necessarily and the details that are not required for understanding the present invention can be omitted. Apart from this, elements that are at least substantially identical or at least having substantially similar functions are shown with the same numeral.

DESCRIPTION OF THE PART REFERENCES

Figure 1:
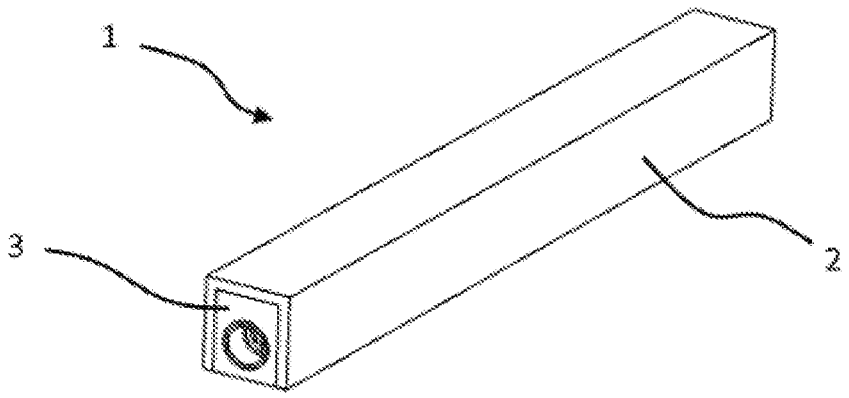
FIG. 1 is an exterior view of the phase shifter of the present invention.
Figure 2:
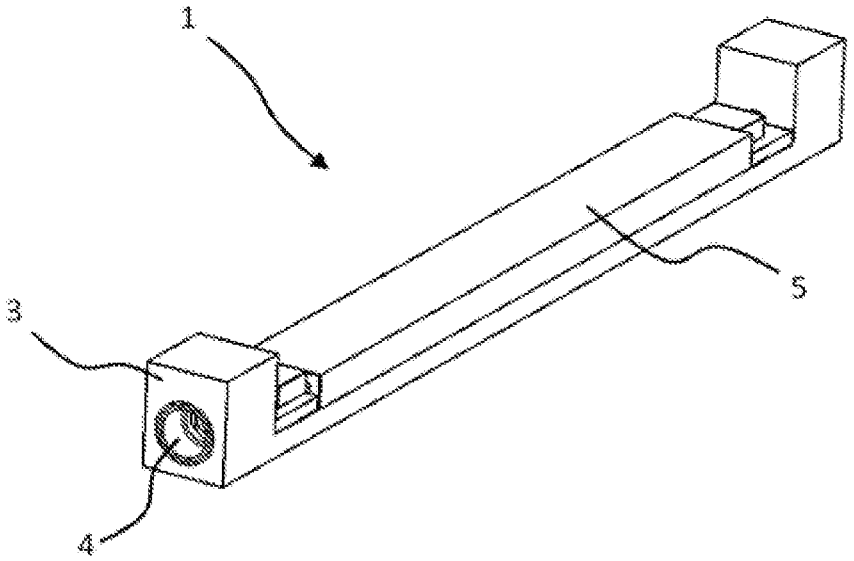
FIG. 2 is an interior structure view of the phase shifter of the present invention.

1. Phase shifter
2. Body
3. Cover
4. RF connector
5. Twin-toroid structure
6. Micro-strip transmission line
7. Dielectric plate
8. Coaxial transmission line

DETAILED DESCRIPTION OF THE EMBODIMENTS

In this detailed description, the preferred embodiments of the invention are only described for clarifying the subject and in a manner without any limitation.

The phase shifter (1) that is particularly used in the radar systems, provides the steering of the micro wave beams comprising; a body (2), a cover (3), a RF connector (4), a twin-toroid structure (5), a micro-strip transmission line (6) and a dielectric plate (7) with high dielectric constant.

Figure 3:
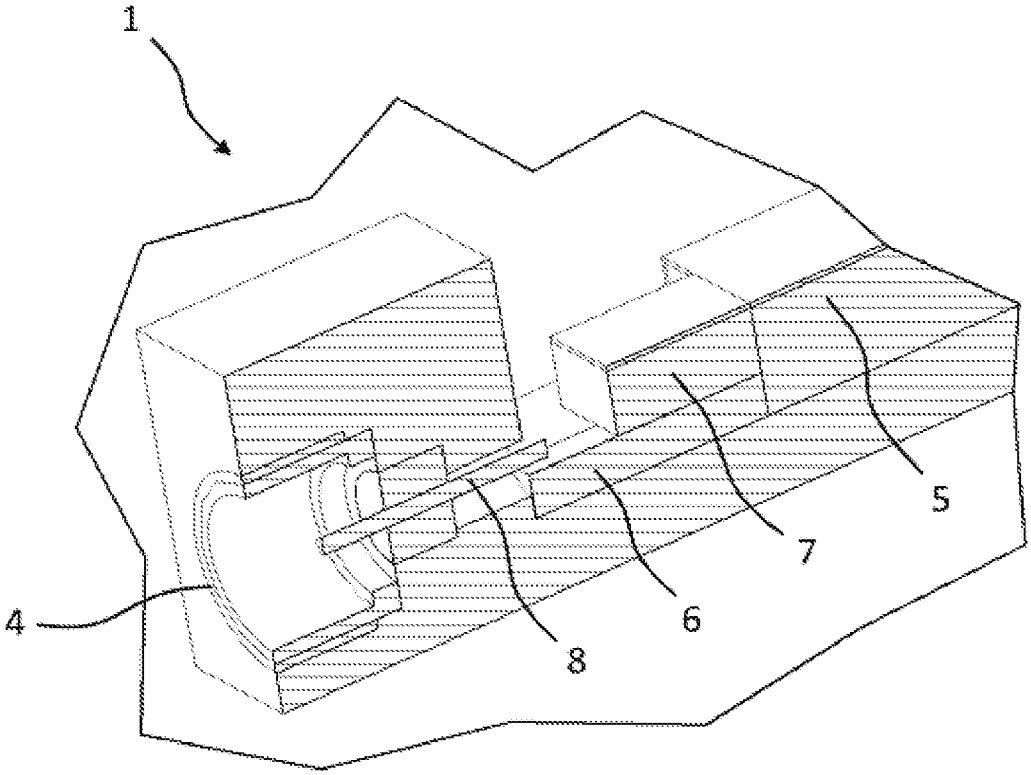
FIG. 3 is a sectional view that shows the transfer from the coaxial transmission line to the wave guide.

In preferred embodiment of the invention, the concentric coaxial transmission line (8) shown in FIG. 3 is used in order to provide the transfer from RF connector (4) to the micro-strip transmission line (6) structure with low reflection.

In the phase shifter (1) of the present invention, the transfer from RF connector (4) to the twin-toroid structure (5) through the concentric coaxial transmission line (8) is provided by means of the micro-strip transmission line (6) and the dielectric plate (7) with high dielectric constant stated in FIG. 3.

The concentric coaxial transmission line (8) coming through the RF connector (4) contacts with the micro-strip transmission line (6). There is a dielectric plate (7) with high dielectric constant on the micro-strip transmission line (6). There is no metal pattern on said dielectric plate (7) with high dielectric constant. The dielectric plate (7) with high dielectric constant provides the gradual transformation of Quasi TEM mode carried by the micro-strip transmission line (6) into TE10 mode carried on the twin-toroid structure (5).

What is claimed is:

1. A phase shifter providing steering of microwave beams, comprising:

a RF connector providing a connection of a coaxial transmission line into the phase shifter;

a micro-strip transmission line providing an interface between the RF connector and a dielectric plate, wherein, the dielectric plate with a high dielectric constant provides a gradual transformation of a quasi TEM mode carried by means of the micro-strip transmission line into a TE10 mode carried on a twin-toroid structure.

2. The phase shifter according to claim 1, wherein, the dielectric plate with the high dielectric constant has no metal pattern.

3. The phase shifter according to claim 1, wherein, the dielectric plate is located on the micro-strip transmission line.

* * * * *